US005133626A

United States Patent [19]

Sleziak et al.

[11] Patent Number: 5,133,626

[45] Date of Patent: Jul. 28, 1992

[54] MOBILE STOPE SUPPORT APPARATUS

[75] Inventors: Gregory Sleziak, Orkney; John T. Barratt, Klerksdorp, both of South Africa; Klaus H. Schneider; Horst W. Kielmann, both of Castrop Rauxel, Fed. Rep. of Germany; Raymond G. Tarr, Klerksdorp, South Africa

[73] Assignee: Crucible S.A., Rue Aldringen, Luxembourg

[21] Appl. No.: 713,004

[22] Filed: Jun. 10, 1991

Related U.S. Application Data

[63] Continuation of Ser. No. 522,632, May 11, 1990, abandoned.

[30] Foreign Application Priority Data

May 11, 1989 [ZA] South Africa ..... 89/3514
Jun. 26, 1989 [ZA] South Africa ..... 89/4830

[51] Int. Cl.[5] ..... E21D 23/04

[52] U.S. Cl. ..... 405/297; 405/293; 405/296; 405/299

[58] Field of Search ..... 405/291, 292, 293, 296, 405/297, 299; 299/31, 33

[56] References Cited

U.S. PATENT DOCUMENTS

| | | | |
|---|---|---|---|
| 3,192,722 | 7/1965 | Herrmann et al. | 405/297 |
| 3,324,664 | 6/1967 | Allen | 405/292 |
| 3,328,967 | 7/1967 | Wilkenloh | 405/297 |
| 3,435,620 | 4/1969 | Weirich et al. | 405/297 |
| 4,102,139 | 7/1978 | Wake | 405/299 |
| 4,217,067 | 8/1980 | Lagodka et al. | 405/296 |
| 4,311,417 | 1/1982 | Bower et al. | 405/297 |
| 4,415,295 | 11/1983 | Werner et al. | 405/291 |

FOREIGN PATENT DOCUMENTS

| | | | |
|---|---|---|---|
| 2848406 | 5/1980 | Fed. Rep. of Germany . | |
| 3325795 | 1/1985 | Fed. Rep. of Germany . | |
| 3730711 | 3/1989 | Fed. Rep. of Germany . | |
| 886886 | 9/1988 | South Africa . | |
| 783480 | 11/1980 | U.S.S.R. | 405/296 |
| 1237774 | 4/1986 | U.S.S.R. | 405/293 |
| 1389111 | 9/1972 | United Kingdom . | |
| 1404594 | 9/1975 | United Kingdom . | |
| 1594032 | 7/1981 | United Kingdom . | |
| 2077339 | 12/1981 | United Kingdom . | |
| 2077832 | 12/1981 | United Kingdom . | |
| 2086462 | 5/1982 | United Kingdom . | |
| 2096680 | 10/1982 | United Kingdom . | |
| 2138062 | 4/1983 | United Kingdom . | |
| 2115048 | 9/1983 | United Kingdom . | |
| 2123885 | 2/1984 | United Kingdom . | |
| 2129476 | 5/1984 | United Kingdom . | |

*Primary Examiner*—David H. Corbin

[57] ABSTRACT

The mobile stope support apparatus comprises a number of individual units (10) which are interconnected by hydraulic cylinders (12). Each of the units (10) has a series of upright, double-acting legs (20). The legs (20) have independent bases of rounded shape and they are pivoted to an overhead canopy (22) which can be raised and lowered by appropriate actuation of the legs. Each unit also has a fore-and-aft hydraulic cylinder (34) which is connected to a common rail (37), the cylinder (34) being pivotable, by the action of a cylinder (36) in an upright plane to raise and lower the rail. By appropriate sequential operation of the various cylinders, the units can be advanced in turn to advance the whole apparatus. In addition, by appropriate operation of the cylinder (36), the front legs (20) can be lifted off the footwall to facilitate movement of the unit over a rough or uneven footwall.

1 Claim, 4 Drawing Sheets

MOBILE STOPE SUPPORT APPARATUS

This application is a continuation of application Ser. No. 522,632, filed on May 11, 1990, now abandoned.

BACKGROUND TO THE INVENTION

THIS invention relates to a mobile stope support apparatus.

A stope support apparatus of the invention is intended for use underground in mine stopes which may have a considerable dip and which invariably, in gold mines at least, have a rough and uneven footwall which has to be traversed by the apparatus as stoping proceeds and the face moves back. Stope support apparatuses which have already been proposed make use of rectangular skids which rest upon the footwall and which are obliged to drag over the footwall surface when the apparatus advances. In cases where the footwall surface is particularly uneven, the known skids are unable to move over that surface with the result that the apparatus is immobilised.

A typical example of a stope support apparatus which suffers from this disadvantage is described in the specification of UK patent 1 404 594. This apparatus makes use of long skids which would be incapable of negotiating a rough and uneven footwall. Other typical examples of the use of a skid-base type apparatus are described in German Offenlegungsschrift 2848406, UK patent 1,389,111, UK patent applications 2 115 048A, 2 123 885A, 2 129 476A, 2 096 680A, 2 086 462A and 2 077 339A. A stope support apparatus which makes use of a number of base-plate skids is described in the specification of UK patent 1,594,032 but even this apparatus is considered unsuitable for efficient movement in a mine stope having a rough and uneven footwall.

It is an object of the present invention to provide an alternative mobile mine stope support apparatus.

SUMMARY OF THE INVENTION

A first aspect of the invention provides a mobile stope support apparatus which comprises:

a) a plurality of mobile units connected to one another;

b) an overhead canopy for each unit;

c) for each unit, double-acting legs which support the canopy, which are resiliently interconnected and which are operable to raise and lower the canopy relative to a hanging wall of the stope; and d) means for causing the units to advance relative to the face of the stope.

Typically, each unit will have four double-acting legs which are interconnected by spring members. Preferably, at least some of the legs are provided with rounded bases enabling them to slide over irregularities on the footwall of the stope.

A second aspect of the invention provides a mobile stope support apparatus which comprises:

a) a plurality of mobile units connected to one another;

b) an overhead canopy for each unit;

c) for each unit, upright double-acting front and rear legs which support the canopy and which are operable to raise and lower the canopy relative to a hanging wall of the stope;

d) a fore-and-aft, double-acting cylinder mounted pivotally on each unit;

e) a rail to which the double-acting cylinders of the units are connected; and f) means for pivoting the double-acting cylinder of each unit in an upright plane to lower the rail onto a footwall of the stope when the canopy is lowered away from the hanging wall and cause some legs of the unit to lift off the footwall while others remain in contact with the footwall, the double-acting cylinder then being operable to pull or push the unit relative to the rail such that those legs remaining in contact with the footwall slide over the footwall.

BRIEF DESCRIPTION OF THE DRAWINGS

The invention will now be described in more detail, by way of example only, with reference to the accompanying drawings in which.

DESCRIPTION OF AN EMBODIMENT

Figure 8:
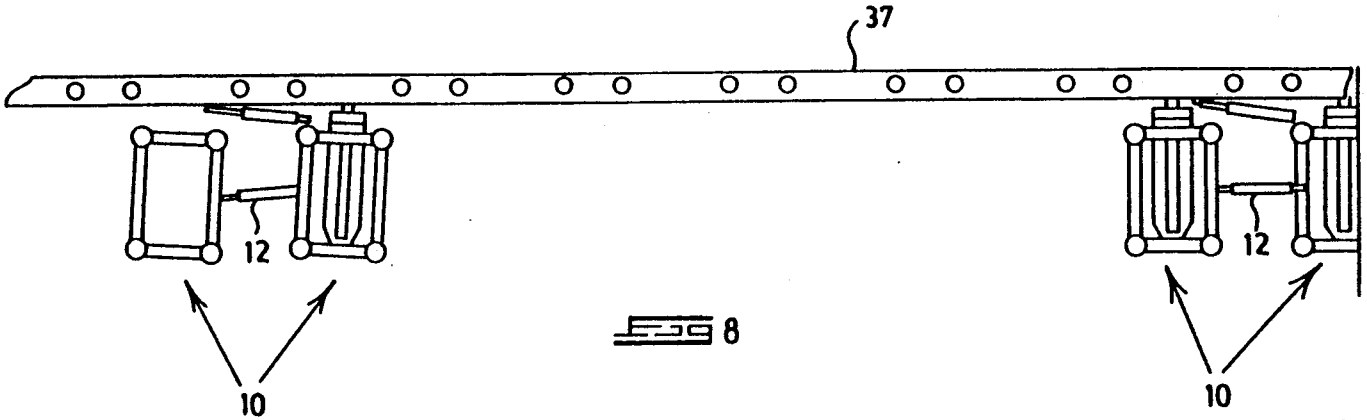
FIG. 8 shows a mobile stope support apparatus of the invention.

Referring firstly to FIG. 8 of the drawings, the mobile stope support apparatus of the invention is made up of a number of separate mobile units 10 which are connected to one another by means of double-acting hydraulic cylinders 12. The face of a stope in which the apparatus operates is designated with the numeral 14 (FIGS. 5 and 6), the hanging wall with the numeral 16 (FIG. 5) and the footwall with the numeral 18 (FIG. 5).

Each unit 10 has four extendable and retractable legs 20 in the form of double-acting hydraulic cylinders. At their upper ends, the legs 20 are connected pivotally to a canopy 22. At their lower ends, the legs 20 have rounded bases 24 of saucer shape, the bases 24A at the rear of the unit being somewhat larger than the bases 24B at the front of the unit. The front legs are connected to one another by means of spring bars 26 and the rear legs are connected to one another by means of similar spring bars 28. Further spring bars 30 connect the front legs to the rear legs as illustrated.

The unit 10 has a frame 32 and two parallel spring steel guide bars 33 which can slide relative to the frame. The frame supports a double-acting hydraulic cylinder 34 which is connected to a block 35. The block 35 also connects the bars 33 to one another at the forward end. A double-acting hydraulic cylinder 36 is mounted on the front spring bars 26 and acts on the block 35 to cause movement of the cylinder 34 in an upright plane. The frame 32 is pivoted at the rear end to the spring bars 28 for movement in a horizontal plane about a pivot point 39. The block 35 is connected pivotally to a robust rail 37 which is common to all the units 10.

Figure 1:
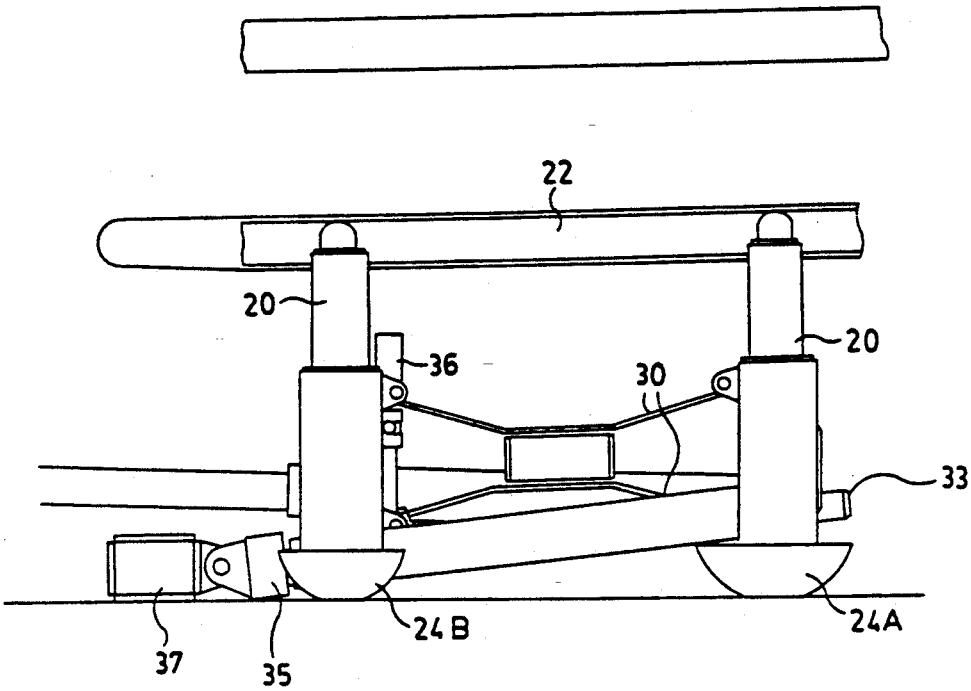
FIG. 1 shows a side view of a single unit of a mobile stope support unit of the invention, some components being omitted in the interest of clarity.
Figure 2:
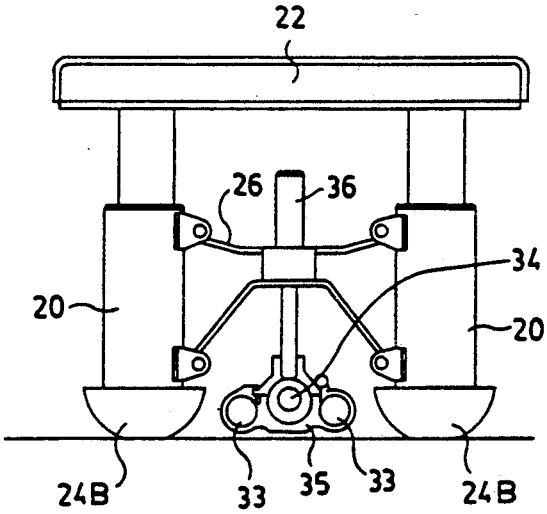
FIG. 2 shows a front end view of the same unit.
Figure 3:
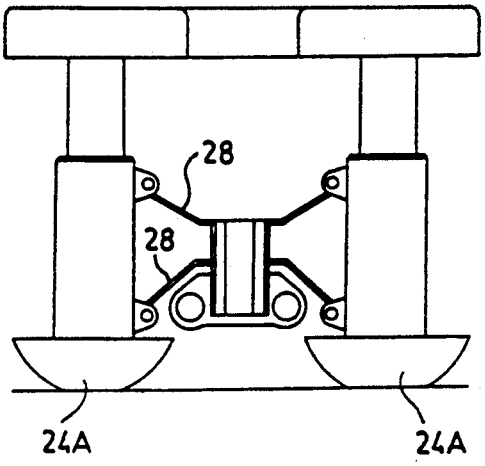
FIG. 3 shows a rear end view of the same unit.
Figure 4:
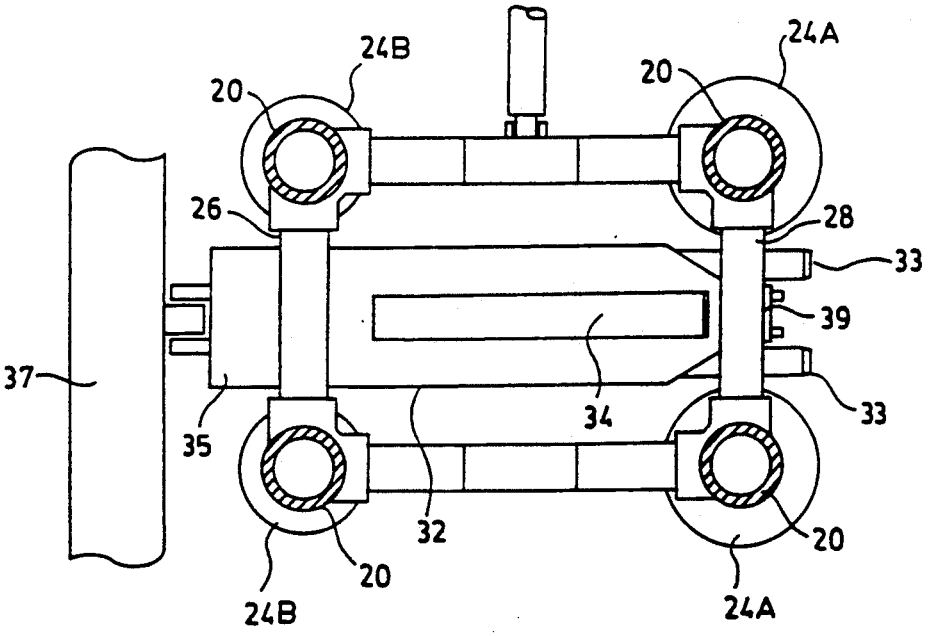
FIG. 4 shows a plan view of the unit.
Figure 5:
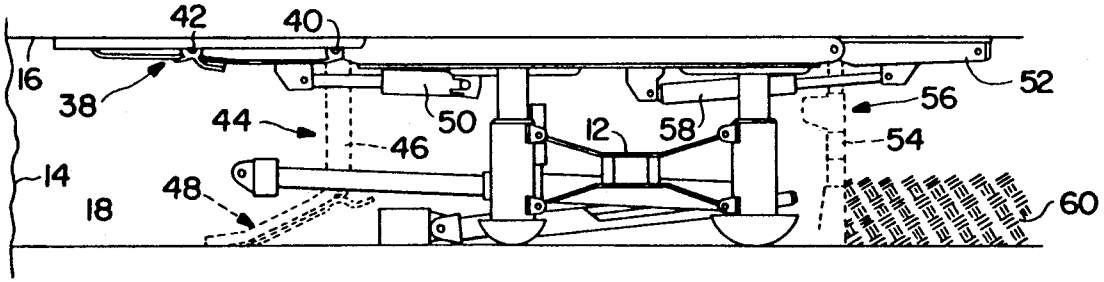
FIG. 5 shows a side view of the same unit with certain other components included.
Figure 6:
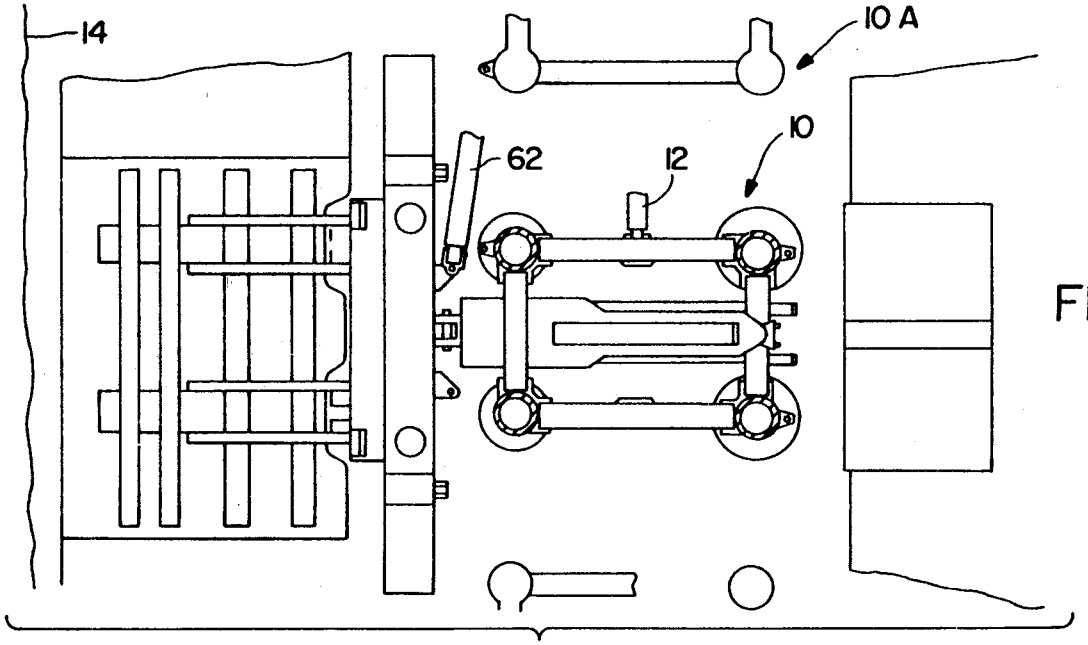
FIG. 6 shows a plan view of the unit as seen in FIG. 5.

Referring now to FIGS. 5 and 6, each unit 10 has a blast barricade 38 which is mounted pivotally to the forward edge of the canopy 22 at a point 40 and which has a hinge 42. FIG. 5 shows the blast barricade in full lines in a horizontal orientation, providing overhead support between the unit 10 and the face 14 of the stope. In broken outline at 44, FIG. 5 shows the blast barricade lowered to an upright orientation in which it provides a blast barrier in front of the stope to protect the unit 10 during blasting operations at the face. It will be noted that movement of the barricade to the upright orientation involves some hinging of the barricade about the hinge 42 with the result that the barricade is then made up of a vertical portion 46 and an inclined portion 48. Pivotal movement of the barricade between its overhead and blast orientations is achieved by means of a double-acting cylinder 50 that acts between the canopy and the barricade.

Pivotally connected to the rear edge of the canopy 22 is a shield 52 carrying a liquid impervious membrane 54. Pivotal movement of the shield takes place between the horizontal orientation seen in full lines and a vertical orientation seen in broken outline at 56, and is achieved by means of a double-acting hydraulic cylinder 58 that acts between the canopy 22 and the shield. In the horizontal position, the shield provides overhead support to the rear of the unit 10. In the vertical position, it provides a barrier behind which backfilling operations can take place using slimes or other waste material 60.

In addition to the various components described above, there is, for each unit 10, a double-acting hydraulic cylinder 62 which connects the rail 37 to the next adjacent unit 10 (see FIG. 6, in which the next unit is designated with the numeral 10A).

The apparatus can be caused to advance relative to the stope face 14 by means of the following steps in sequence:

1) After a blasting operation and subsequent clearing of the broken rock by conventional means such as scraper scoops, and assuming that the canopy 22 and blast barricade 38 are in the horizontal position against the hanging wall 16, the cylinder 36 is retracted to pivot the cylinder 34 upwardly. This raises the rail 37 above the footwall. This step is carried out by all units simultaneously.

2) The cylinder 34 is extended to advance the rail 37 towards the stope face. Because the rail 37 has already been raised (step 1) local irregularities on the footwall do not interfere with movement of the rail towards the stope face. This situation is depicted in in FIG. 5.

3) The cylinder 36 is now extended to pivot the cylinder 34 downwardly such that the rail 37 is again in contact with the footwall. This step is carried out by all units simultaneously.

4) All legs 20 of the unit 10 are now retracted to lower the canopy 22 and associated blast barricade 38 and shield 52 away from the hanging wall 16.

5) The cylinder 36 is extended further with the result that the forward legs 20 lift right off the footwall, leaving only the two rear legs 20 in contact with the footwall.

6) The cylinder 34 is retracted to pull the relevant unit 10 towards the rail 37. During this operation, the other units 10 remain stationary. Movement of the unit 10 takes place by sliding of the bases 24A over the footwall. The large saucer-shapes of the bases enable them to negotiate local irregularities in the footwall surface. If there should be a marked dip in the stope, i.e. a slope in a direction transverse to the fore-and-aft direction, the interconnecting cylinders 12 can be used to prevent down-dip slippage of the unit 10 during this movement.

7) Once the relevant unit 10 has been advanced by the cylinder 34, the cylinder 36 is again retracted to permit the front legs of the unit to resume contact with the footwall.

8) The legs 20 are then extended to bring the canopy 22 and associated blast barricade 38 and shield 52 back into contact with the hanging wall.

9) Steps 4 to 8 are then carried out for each unit 10, the final situation being that the whole apparatus has been advanced, by the stroke of the cylinder 34, towards the stope face 14.

It is also possible to move the entire apparatus in the direction of dip, i.e. down-dip or up-dip. This is achieved by appropriate extension or retraction of all cylinders 62 simultaneously to move the rail 37 up or down the dip, and then by appropriate operation of the interconnecting cylinders 12 and cylinder 34 during further advance sequences.

Figure 7:
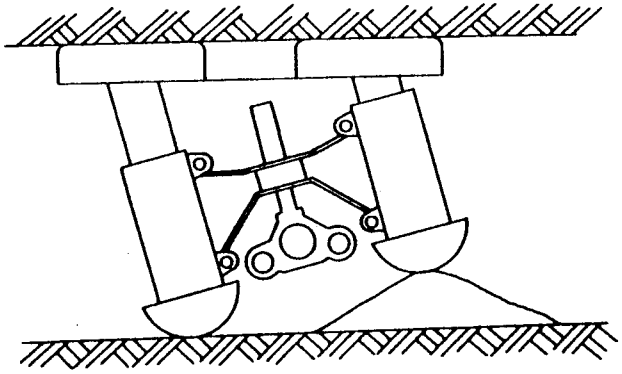
FIG. 7 shows an end view of the unit and illustrates its ability to negotiate an uneven footwall.

An important feature of the described apparatus is the resilient interconnection of the legs of the units 10 by means of the spring bars 26, 28 and 30. FIG. 7 gives an exemplary illustration of the ability of each unit 10 to stand stably on its legs 20 irrespective of fairly marked local irregularities in the footwall 18.

Another important feature of the described apparatus is the facility to raise two legs of each unit off the footwall during advance movements, making it easier for the units 10 to advance without snagging on footwall irregularities.

In addition to the features discussed above, the apparatus of the invention may include drilling and other ancillary equipment mounted movably on the rail 37.

We claim:

1. A mobile stope support apparatus comprising:

a) a plurality of mobile units connected to one another;

b) an overhead canopy for each unit;

c) for each unit, a pair of upright, double-acting front legs and a pair of upright, double-acting rear legs which support the canopy and which are operable to raise and lower the canopy relative to a hanging wall of the stope;

d) first resilient spring means which extends between and interconnects the legs of the front pair, second resilient spring means which extends between and interconnects the legs of the rear pair, third spring means which extends between and interconnects one leg of the front pair with one leg of the rear pair, and fourth spring means which extends between and interconnects the other leg of the front pair with the other leg of the rear pair, the first, second, third and fourth spring means permitting the legs to assume different orientations from one another to take account of local irregularities in a footwall of the stope;

e) for each front and each rear leg, an independent base which contacts the footwall of the stope;

f) a first fore-and-aft, double-acting cylinder mounted pivotally on each unit;

g) a rail to which the double-acting cylinders of the units are connected;

h) second double-acting cylinders inclined to a fore and aft direction of the rail are connected between each unit and the rail, and third double-acting cylinders connected between the units, the second and third cylinders being operable to move the units up dip or down dip relative to the rail; and i) means for pivoting the first double-acting cylinder of each unit in an upright plane to lower the rail onto the footwall of the stope when the canopy is lowered away from the hanging wall and cause the front pair of legs to lift off the footwall while the rear pair of legs remain in contact with the footwall, the first double-acting cylinder then being operable to pull or push the unit relative to the rail such that the independent bases of the rear pair of legs slide over the footwall.

* * * * *